US012788084B1

(12) United States Patent
Sutton, Jr.

(10) Patent No.: US 12,788,084 B1
(45) Date of Patent: Nov. 10, 2026

(54) KNEE PAD SYSTEM

(71) Applicant: Philip J. Sutton, Jr., South Berwick, ME (US)

(72) Inventor: Philip J. Sutton, Jr., South Berwick, ME (US)

( * ) Notice: Subject to any disclaimer, the term of this patent is extended or adjusted under 35 U.S.C. 154(b) by 0 days.

(21) Appl. No.: 19/316,404

(22) Filed: Sep. 2, 2025

(51) Int. Cl.
*A41D 13/06* (2006.01)
*A41D 13/05* (2006.01)

(52) U.S. Cl.
CPC ..... *A41D 13/065* (2013.01); *A41D 13/0562* (2013.01); *A41D 13/0575* (2013.01)

(58) Field of Classification Search
CPC ..... A41D 13/065; A41D 13/0562; A41D 13/0575
USPC ..... 2/24
See application file for complete search history.

(56) References Cited

U.S. PATENT DOCUMENTS

| | | | | |
|---|---|---|---|---|
| 4,831,666 | A * | 5/1989 | Denman | A41D 13/0575 2/24 |
| 4,888,826 | A * | 12/1989 | Parsons, Jr. | A63B 71/1225 2/22 |
| 4,999,847 | A * | 3/1991 | Barcelo | A63B 71/1225 2/24 |
| 10,757,987 | B2 * | 9/2020 | Pratson | A41D 13/0158 |
| 2024/0260688 | A1 * | 8/2024 | Cremins | A41D 15/00 |
| 2024/0277086 | A1 * | 8/2024 | Karakoc | A41D 13/065 |

* cited by examiner

*Primary Examiner* — Timothy K Trieu
(74) *Attorney, Agent, or Firm* — Pierce Atwood LLP

(57) ABSTRACT

A knee pad system is provided which includes a lower portion including a knee pad shell and at least one removable fastener, and an upper portion including at least one removable fastener. The lower portion is coupled to the upper portion, and the lower portion of the knee pad system pivots between a stowed configuration and a deployed configuration. In the stowed configuration, the lower portion pivots onto the upper portion such that the at least one removable fastener on the lower portion aligns with the at least one removable fastener on the upper portion to removably secure the lower portion to the upper portion. In the deployed configuration, the lower portion pivots away from the upper portion such that the knee pad shell is configured to extend downwardly to protect a user's knee. A method of protecting a user's knee with a knee pad system is also provided.

16 Claims, 4 Drawing Sheets

KNEE PAD SYSTEM

FIELD OF THE INVENTION

The invention relates to a knee pad system for selectively protecting a user's knee.

BACKGROUND

Conventional knee pads are known for various types of workers and gardeners. A typical knee pad has a "slip-on" style which may include a sleeve design where the user slides the sleeve over the foot, up the calf, and the knee pad is secured around the user's knee.

SUMMARY OF THE INVENTION

According to one aspect of the present disclosure, a knee pad system is provided which includes a lower portion including a knee pad shell and at least one removable fastener, and an upper portion including at least one removable fastener, where the lower portion is coupled to the upper portion. The lower portion of the knee pad system pivots between a stowed configuration and a deployed configuration. In the stowed configuration, the lower portion pivots onto the upper portion such that the at least one removable fastener on the lower portion aligns with the at least one removable fastener on the upper portion to removably secure the lower portion to the upper portion, and in the deployed configuration, the lower portion pivots away from the upper portion such that the knee pad shell is configured to extend downwardly to protect a user's knee.

According to another aspect of the present disclosure, a method of protecting a user's knee with a knee pad system is provided which includes providing a knee pad system which includes a lower portion including a knee pad shell and at least one removable fastener, and an upper portion including at least one removable fastener, where the lower portion is coupled to the upper portion. The method also includes pivoting the lower portion of the knee pad system into a stowed configuration where the lower portion pivots onto the upper portion such that the at least one removable fastener on the lower portion aligns with the at least one removable fastener on the upper portion to secure the lower portion in the stowed configuration, and pivoting the lower portion of the knee pad system into a deployed configuration where the lower portion pivots away from the upper portion such that the knee pad shell extends downwardly to protect a user's knee.

DETAILED DESCRIPTION

The present disclosure is directed to a knee pad system. It is contemplated that this knee pad system may be beneficial in a variety of professions, including, but not limited to various workers, construction workers, firefighters, gardeners and/or tradespeople to eliminate and/or lessen the discomfort and hassle of conventional knee pads.

Applicant recognized that there were problems associated with conventional knee pads. For example, a conventional sleeve-design knee pad may be uncomfortable for long-term wear, may cause irritation behind the user's knees, and may even cut off circulation in the user's legs. Furthermore, conventional knee pads require manual removal and/or repositioning of the knee pad when switching between standing and kneeling tasks. Also, some conventional knee pads frequently slip out of place, thus reducing their effectiveness. Finally, Applicant recognized that many conventional knee pads take extra time to put on and/or adjust, which can interrupt workflow.

Accordingly, aspects of the present disclosure are directed to addressing one or more of the above problems associated with conventional knee pads. As forth in more detail below, in one embodiment, the knee pad system includes a portion that pivots between a stowed configuration and a deployed configuration. In the deployed configuration, a portion of the knee pad system may extend downwardly to protect a user's knee. When knee protection is not needed, the portion of the knee pad system may pivot up and away from the user's knee in the stowed position. As set forth below, removable fasteners may be located on the knee pad system to secure the knee pad system in the stowed position and/or the deployed configuration. In one embodiment, the knee pad system is configured to save time, reduce strain, and prevent the pain associated with conventional knee pads which can dig into the back of a user's knee.

As set forth in more detail below, in one embodiment, the knee pad system is incorporated into a garment, such as, but not limited to a pair of pants, shorts, overalls, and/or other work gear. It is also contemplated that in one embodiment, the garment may be a removable utility sleeve that clips onto another garment. In one embodiment, the knee pad system is separate from a garment, and may be configured with one or more fasteners to removably secure the knee pad system to a garment.

Figure 1:
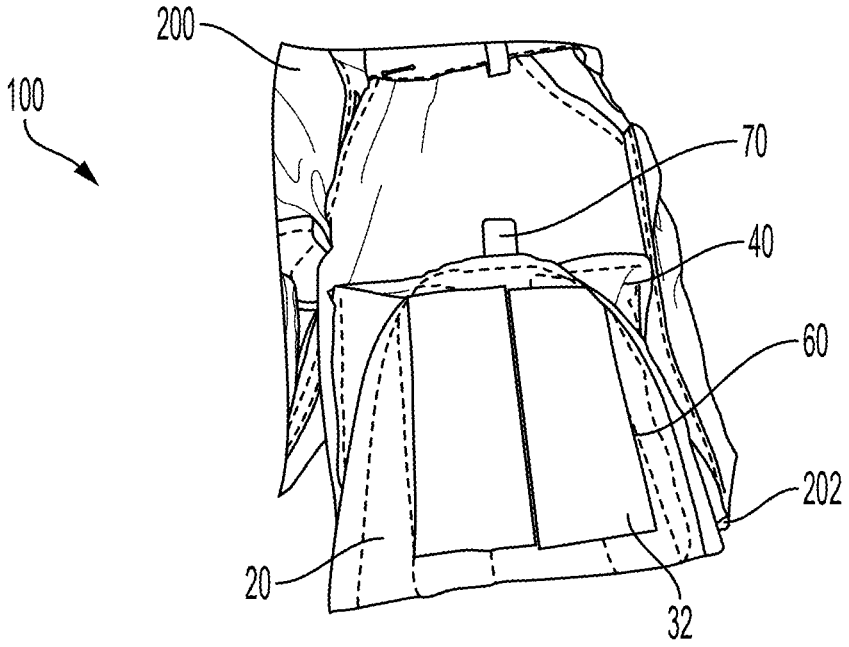
FIG. 1 illustrates one embodiment of a knee pad system in a stowed configuration.
Figure 2:
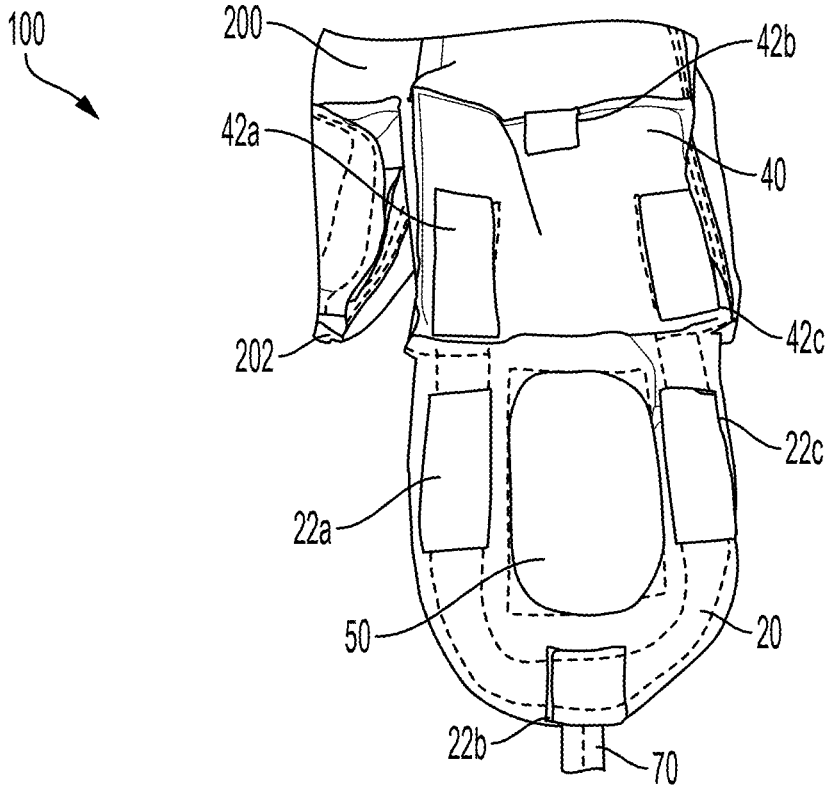
FIG. 2 illustrates one embodiment of a knee pad system in a deployed configuration.

Turning now to FIGS. 1-2, one embodiment of a knee pad system 100 will now be described. FIG. 1 illustrates one embodiment of a knee pad system 100 in a stowed configuration, whereas FIG. 2 illustrates the knee pad system in a deployed configuration. As illustrated, in this embodiment, the knee pad system 100 includes a lower portion 20 including at least one removable fastener 22*a*, 22*b*, 22*c*, and an upper portion 40 including at least one removable fastener 42*a*, 42*b*, 42*c*, and as shown, the lower portion 20 is coupled to the upper portion 40. As set forth in more detail below, the lower portion 20 also includes a knee pad shell 10 (see FIG. 4). As shown in the stowed position shown in FIG. 1, the lower portion 20 pivots onto the upper portion 40 such that the at least one removable fastener 22*a*, 22*b*, 22*c* on the lower portion 20 aligns with the at least one removable fastener 42*a*, 42*b*, 42*c* on the upper portion 40 to removably secure the lower portion 20 to the upper portion 40. As shown in the deployed position shown in FIG. 2, the lower portion 20 pivots away from the upper portion 40 such that the knee pad shell 10 (which may be positioned substantially behind the patch 50 shown in FIG. 2) is configured to extend downwardly to protect a user's knee.

As shown in FIG. 2, in one embodiment, the lower portion 20 of the knee pad system may include a patch 50. In one embodiment, the patch 50 may be a reinforcement patch 50 to provide an outer support layer to the knee pad system. As shown in FIG. 1, in one embodiment, the lower portion 20 of the knee pad system may include another patch 60. In one embodiment, the patch 60 may be a rubber patch 60 and may provide cushioning to a user's knee. Other details regarding these patches 50, 60 are provided in more detail below. It should be appreciated that in one embodiment, the knee pad shell 10 is in the lower portion 20 and sandwiched between these two patches 50, 60 shown in FIGS. 1-2.

As shown in FIGS. 1-2, in one embodiment, the knee pad system 100 is incorporated into a garment, such as a pair of shorts 200. As shown, in one embodiment, the knee pad system may be sewn, or otherwise coupled to the garment, and in this embodiment, in the stowed configuration shown in FIG. 1, the knee pad system 100 extends substantially above the hem line 202 of the shorts 200, whereas in the deployed configuration shown in FIG. 2, the lower portion 20 extends below the hem line 202 of the shorts 200. As mentioned above, in another embodiment, the knee pad system 100 may be incorporated into another type of garment, as the disclosure is not so limited.

Figure 3:
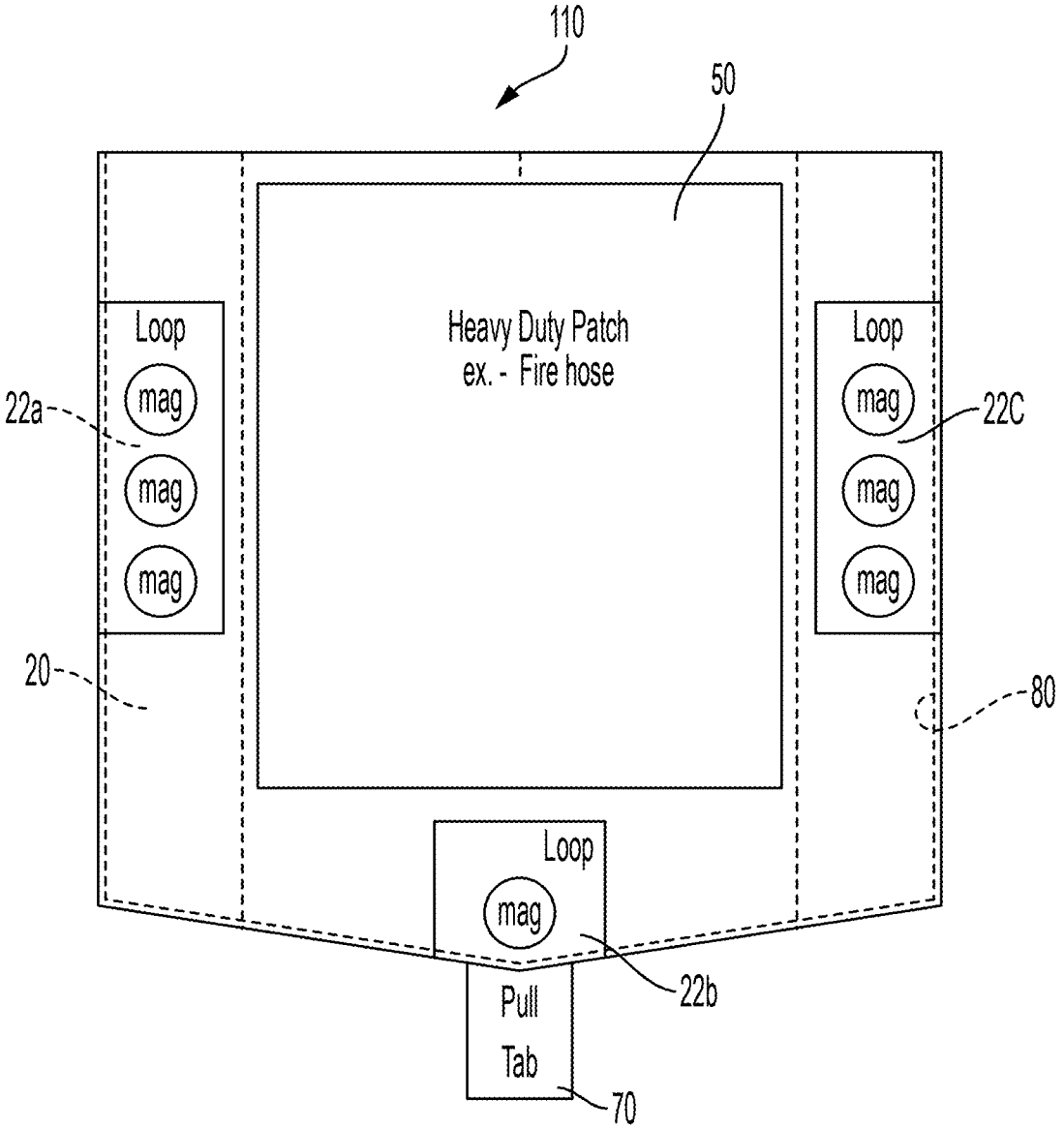
FIG. 3 illustrates a first panel which may form a portion of the knee pad system according to one embodiment.
Figure 4:
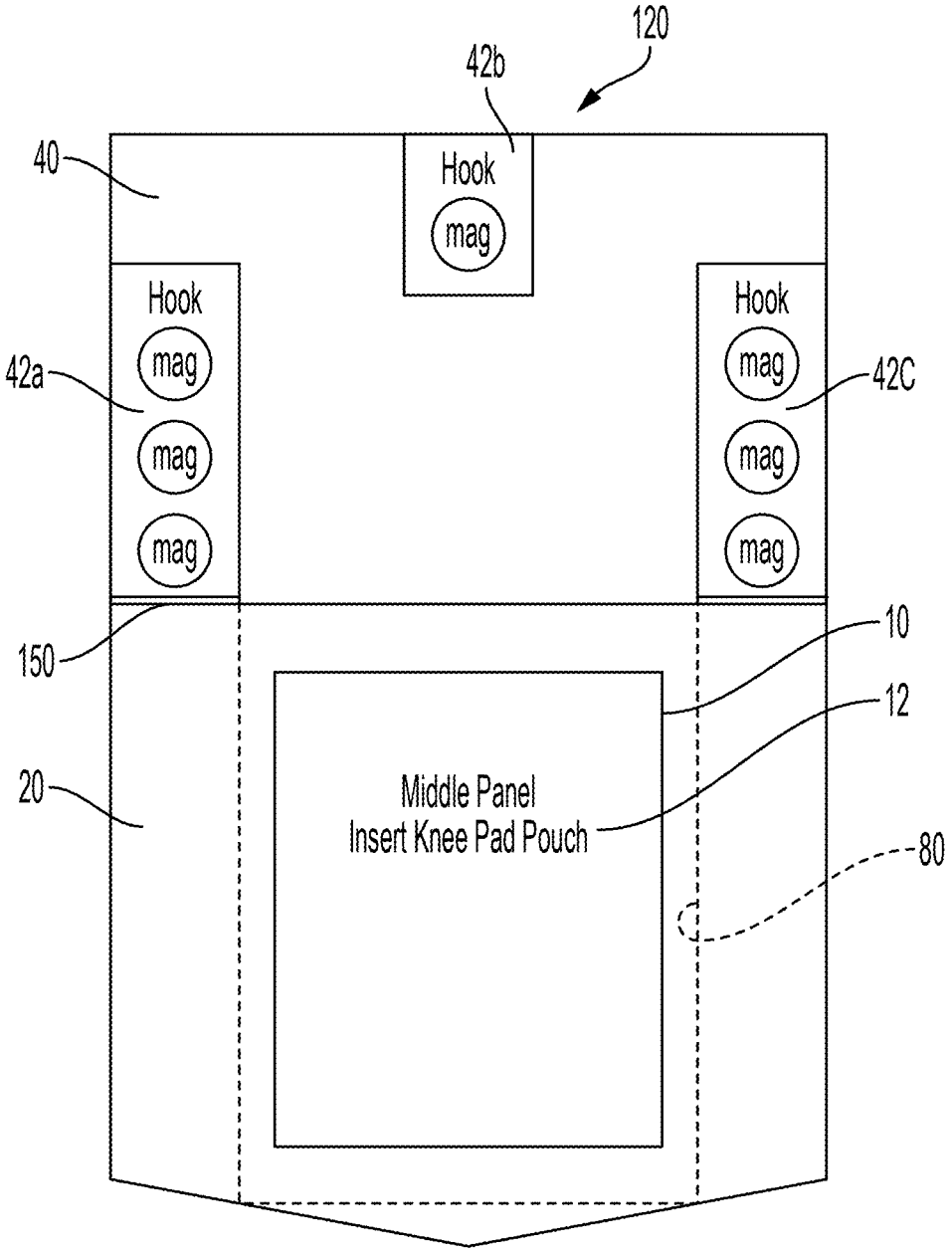
FIG. 4 illustrates a second panel which may form a portion of the knee pad system according to one embodiment.
Figure 5:
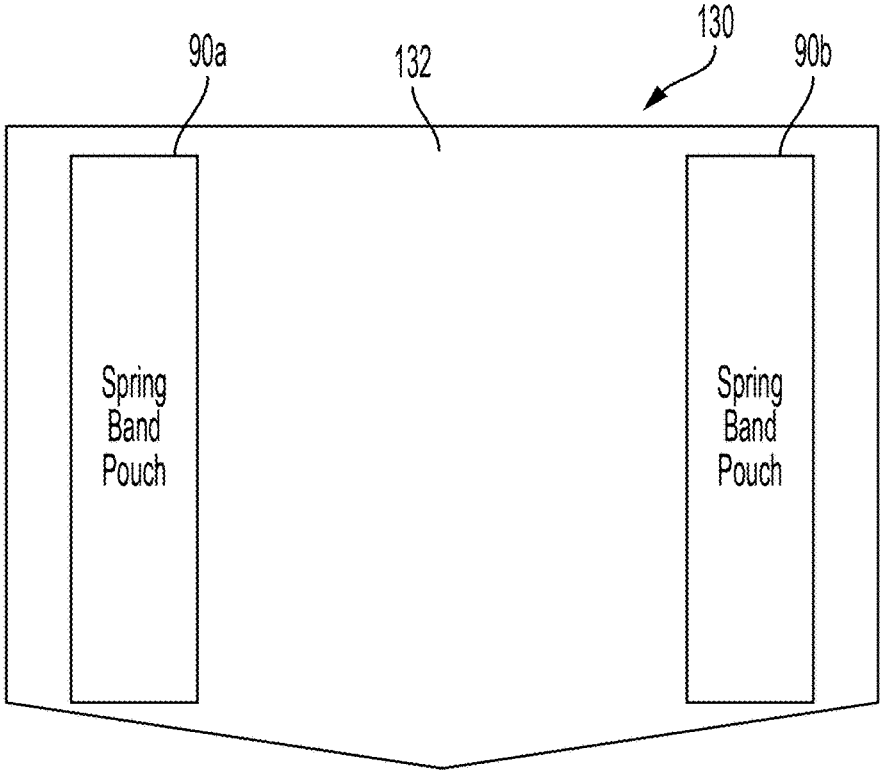
FIG. 5 illustrates a first side of a third panel which may form a portion of the knee pad system according to one embodiment.
Figure 6:
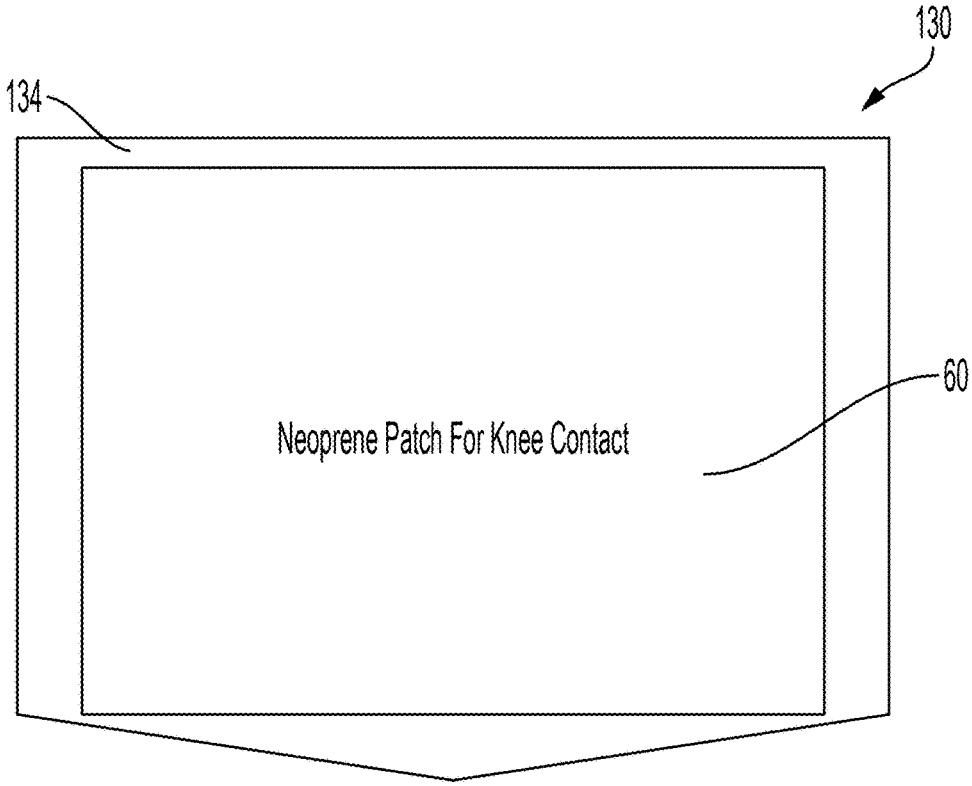
FIG. 6 illustrates a second side of the third panel according to one embodiment.

Turning now to FIG. 3-6, additional details of the knee pad system 100 will now be more fully described. In one embodiment, the knee pad system 100 includes a plurality of panels which may be sewn, or otherwise coupled together. For example, FIG. 3 illustrates a first panel 110 which may form a portion of the knee pad system 100, FIG. 4 illustrates a second panel 120 which may form a portion of the knee pad system 100, and FIG. 5-6 illustrate a third panel 130 which may form a portion of the knee pad system 100.

As set forth in more detail below, in one embodiment, the above-described lower portion 20 of the knee pad system 100 is formed by the first panel 110, the second panel 120, and the third panel 130, and the above-described upper portion 40 may be formed by the second panel 120.

As shown in FIG. 3, in one embodiment, the first panel 110 may include the at least one removable fastener 22*a*, 22*b*, 22*c*. As shown, in this particular embodiment, there is a first removable fastener 22*a* on the medial side of the lower portion 20, and a second removable fastener 22*c* on the lateral side of the lower portion 20. As shown in FIG. 3, there may also be a third removable fastener 22*b* on a lower segment of the lower portion 20. As shown in FIG. 3, in one embodiment, these removable fasteners 22*a*, 22*b*, 22*c* on the lower portion 20 may include hook and loop fasteners, magnets, snaps, buttons, zippers, loops, and/or straps. As shown, in one particular embodiment, hook/loop fasteners as well as magnets may be provided to secure the lower portion 20 to the upper portion 40 in the stowed position.

FIG. 4 illustrates a second panel 120 which may form a portion of the knee pad system 100. As shown, in one embodiment, the second panel 120 forms at least a portion of both the lower portion 20 and the upper portion 40, and in one embodiment, the second panel 120 includes a fold line 150 where the lower portion 20 pivots between the stowed configuration and the deployed configuration about the fold line 150.

As shown in FIG. 4, the second panel 120 may include at least one removable fastener 42*a*, 42*b*, 42*c*. As shown, in this particular embodiment, there is a first removable fastener 42*a* on the medial side of the upper portion 40, and a second removable fastener 42*c* on the lateral side of the upper portion 40. As shown in FIG. 4, there may also be a third removable fastener 42*b* on an upper segment of the upper portion 40. As shown in FIG. 4, in one embodiment, these removable fasteners 42*a*, 42*b*, 42*c* on the upper portion 40 may include hook and loop fasteners, magnets, snaps, buttons, zippers, loops, and/or straps. As shown, in one particular embodiment, hook/loop fasteners as well as magnets may be provided to secure the lower portion 20 to the upper portion 40 in the stowed position. Furthermore, in one particular embodiment featuring hook and loop fasteners, the loop fasteners 22*a*, 22*b*, 22*c* may be provided on one of the upper and lower portions 20, 40, and the hook fasteners 42*a*, 42*b*, 42*c* may be provided on the other portion 20, 40.

As also shown in FIG. 4, the lower portion 20 may include a pouch or pocket 12 configured to receive the above-mentioned knee pad shell 10. In one embodiment, the knee pad shell 10 is removably received in the pocket 12. In one embodiment, the pocket 12 is formed between the first panel 110 (FIG. 3) and the second panel 120 (FIG. 4).

Turning now to FIGS. 5 and 6, the third panel 130 will now be more fully described. As mentioned above, the third panel 130 may form part of the lower portion 20. FIG. 5 illustrates a first side 132 of the third panel 130, whereas FIG. 6 illustrates a second side 134 of the third panel 130. In one embodiment, the lower portion 20 includes at least one spring band 90 so that in the deployed configuration, the lower portion 20 forms to the shape of a user's knee. As shown in FIG. 5, in one embodiment, the at least one spring band 90 includes a first spring band 90*a* positioned on a medial side of the lower portion 20 and a second spring band 90*b* positioned on a lateral side of the lower portion 20. It should be appreciated that in one embodiment, the spring bands 90*a*, 90*b* may be substantially flat flexible band when in the stowed position, but when in the deployed configuration, the spring bands 90*a*, 90*b* may curl to the curvature of a user's knee. In one embodiment, the spring bands 90*a*, 90*b* may be received within a pouch or pocket, which may for example, be formed between at least two of the first, second and third panels 110, 120, 130. It should be recognized that this pocket may also act to restrain the curling of the spring band 90*a*, 90*b* such that the total bending of the spring band is between 90° (knee bent at approximately a right angle) and 180° (knee substantially straight/unbent). One of ordinary skill in the art would appreciate that the spring bands 90*a*, 90*b* may be made of various types of metal and plastic materials, and in one embodiment, may be made from a bistable spring also known as a slap bracelet.

FIG. 6 shows that in one embodiment, the third panel 130 may include a patch 60. As mentioned above, in one embodiment, this is a rubber patch 60, and may, for example, be made of neoprene. As shown in FIG. 6, the patch 60 is coupled to the second side 134 of the third panel 130, which may form an inner surface of the lower portion 20.

As shown in FIGS. 1-2, in one embodiment, the knee pad system 100 also includes a pull tab 70 which a user can grab to pivot the lower portion 20 between the stowed configuration (FIG. 1) and the deployed configuration (FIG. 2).

A variety of types of materials may be used to form the knee pad shell 10. In one embodiment, the knee pad shell 10 is a molded semi-rigid protective pad. In another embodiment the knee pad shell 10 includes a gel insert, a memory foam, ethylene-vinyl acetate (EVA) foam, and/or ballistic nylon.

As mentioned above, and as shown in FIG. 2, in one embodiment, knee pad system 100 may include a reinforcement patch 50 to provide an outer support layer to the knee pad system 100. It is contemplated that the patch 50 may be made of materials such as but not limited to, Ballistic Nylon, (1050D or higher), Cordura Nylon (1000D), Kevlar Fabric, and/or Hypalon (CSM Rubber-Coated Fabric).

As shown in FIGS. 3-6, in one embodiment, the knee pad system 100 includes a first panel 110, a second panel 120, and a third panel 130, where the second panel 120 is sandwiched between the first panel 110 and the third panel 130. In one embodiment, the lower portion 20 of the knee pad system 100 is formed by the first panel 110, the second panel 120 and the third panel 130, and the upper portion 40 of the knee pad system 100 is formed by the second panel 120. In one embodiment, the lower portion 20 includes a pocket 12 formed between the first panel 110 and the second panel 120, where the knee pad shell 10 is removably received in the pocket 12. As shown in FIGS. 3-4, in one embodiment, the first panel 110, the second panel 120, and the third panel 130 are sewn together at seams 80 to form the knee pad system 100.

As mentioned above, in one embodiment, the knee pad system 100 may be incorporated into a garment. Accordingly, in one embodiment, the knee pad system 100 may be made from garment materials, such as, but not limited to various fabrics which may include cotton, canvas, polyester blends, denim, etc. In one embodiment, the above-described first, second, and third panels 110, 120, 130 may each be formed from a fabric layer which are sewn together at one or more seams 80 to form the knee pad system 100. In another embodiment, it is also contemplated that the knee pad system 100 may be made from various plastic layers, films, natural and/or industrial fibers, rubber-based fabrics (that may not include plastic films), industrial repurposed materials, and/or hybrid layering (non-film approach.

As described above, the knee pad system 100 includes a lower portion 20 which may pivot between a stowed configuration (FIG. 1) and a deployed configuration (FIG. 2). As shown in FIG. 4, in one embodiment, the knee pad system 100 is configured to pivot/bend about a fold line 150. The present disclosure also contemplates other types of configurations which enable the lower portion 20 to pivot relative to the upper portion 40, including, but not limited to a mechanical hinge, or other type of rotating pivot mechanism.

Aspects of the present disclosure are directed to methods of protecting a user's knee with a knee pad system. The method may include providing a knee pad system which includes a lower portion including a knee pad shell and at least one removable fastener, and an upper portion including at least one removable fastener, where the lower portion is coupled to the upper portion. The method may also include pivoting the lower portion of the knee pad system into a stowed configuration where the lower portion pivots onto the upper portion such that the at least one removable fastener on the lower portion aligns with the at least one removable fastener on the upper portion to secure the lower portion in the stowed configuration. The method may further include pivoting the lower portion of the knee pad system into a deployed configuration where the lower portion pivots away from the upper portion such that the knee pad shell extends downwardly to protect a user's knee.

Although several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. Those skilled in the art will recognize or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A knee pad system comprising:

a lower portion including a knee pad shell and at least one removable fastener;

an upper portion including at least one removable fastener, wherein the lower portion is coupled to the upper portion; and wherein the lower portion of the knee pad system moves between a stowed configuration and a deployed configuration, wherein in the stowed configuration, the lower portion is coupled to the upper portion such that the at least one removable fastener on the lower portion aligns with the at least one removable fastener on the upper portion to removably secure the lower portion to the upper portion, and in the deployed configuration, the lower portion is deployed away from the upper portion such that the knee pad shell is configured to extend downwardly to protect a user's knee.

2. The knee pad system of claim 1, wherein the knee pad system is incorporated into a garment.

3. The knee pad system of claim 1, wherein the lower portion further comprises at least one spring band so that in the deployed configuration, the lower portion forms to a user's knee.

4. The knee pad system of claim 3, wherein the at least one spring band includes a first spring band positioned on a medial side of the lower portion, and a second spring band positioned on a lateral side of the lower portion.

5. The knee pad system of claim 1, wherein the at least one removable fastener on the lower portion and upper portion each includes mating first removable fasteners on the medial sides of the lower and upper portions, and mating second removable fasteners on the lateral sides of the lower and upper portions.

6. The knee pad system of claim 5, wherein the at least one removable fastener on the lower portion and upper portion each further includes mating third removable fasteners on a lower segment of the lower portion and an upper segment of the upper portion.

7. The knee pad system of claim 1, wherein the at least one removable fastener on the lower portion and upper portion includes at least one of hook and loop fasteners, magnets, snaps, buttons, zippers, loops, and straps.

8. The knee pad system of claim 7, wherein the at least one removable fastener on the lower portion and upper portion includes both hook and loop fasteners and magnets positioned about a periphery of the upper and lower portions of the knee pad system.

9. The knee pad system of claim 1, further comprising a rubber patch coupled to an inner surface of the lower portion of the knee pad system, and when the lower portion is in the deployed configuration, the rubber patch provides cushioning to a user's knee.

10. The knee pad system of claim 1, further comprising a reinforcement patch coupled to an outer surface of the lower portion of the knee pad system, and when the lower portion in the deployed configuration, the reinforcement patch provides an outer support layer to the knee pad system.

11. The knee pad system of claim 1, wherein the lower portion further comprises a pocket, wherein the knee pad shell is removably received in the pocket.

12. The knee pad system of claim 1, wherein the lower portion further comprises a pull tab to pivot the lower portion between the stowed configuration and the deployed configuration.

13. The knee pad system of claim 1, wherein the knee pad shell includes at least one of a molded semi-rigid protective pad, a gel insert, a memory foam, ethylene-vinyl acetate (EVA) foam, and ballistic nylon.

14. The knee pad system of claim 1, wherein the lower portion of the knee pad system moves between the stowed configuration and the deployed configuration by pivoting the lower portion of the knee pad system about a fold line.

15. A method of protecting a user's knee with a knee pad system comprising:

providing a knee pad system which includes a lower portion including a knee pad shell and at least one removable fastener, and an upper portion including at least one removable fastener, wherein the lower portion is coupled to the upper portion;

moving the lower portion of the knee pad system into a stowed configuration wherein the lower portion extends over the upper portion such that the at least one removable fastener on the lower portion aligns with the at least one removable fastener on the upper portion to secure the lower portion in the stowed configuration; and moving the lower portion of the knee pad system into a deployed configuration wherein the lower portion is deployed away from the upper portion such that the knee pad shell extends downwardly to protect a user's knee.

16. The method of claim 15, wherein the lower portion of the knee pad system moves between the stowed configuration and the deployed configuration by pivoting the lower portion of the knee pad system about a fold line.

* * * * *